US005389759A

United States Patent [19]

Jay et al.

[11] Patent Number: 5,389,759

[45] Date of Patent: Feb. 14, 1995

[54] MICROWAVE CONTAINER

[75] Inventors: Anthony S. Jay, Hillingdon; Elizabeth M. Sands, Hayes; Joy C. Taylor, Woodplumpton; Alan Norman, Pontnewydd, all of United Kingdom

[73] Assignee: A.G. (Patents) Limited, London, United Kingdom

[21] Appl. No.: 836,311

[22] PCT Filed: Aug. 30, 1990

[86] PCT No.: PCT/GB90/01338

§ 371 Date: Apr. 27, 1992

§ 102(e) Date: Apr. 27, 1992

[87] PCT Pub. No.: WO91/03917

PCT Pub. Date: Mar. 21, 1991

[30] Foreign Application Priority Data

Aug. 30, 1989 [GB] United Kingdom ..... 8919602

[51] Int. Cl.[6] ..... H05B 6/80

[52] U.S. Cl. ..... 219/734; 99/DIG. 14; 426/107; 426/113; 426/234; 426/243; 426/262; 219/725

[58] Field of Search ..... 219/10.55 E, 10.55 F, 219/10.55 M; 426/107, 113, 118, 234, 243, 250, 262, 269, 305, 549, 94, 96, 302; 99/DIG. 14

[56] References Cited

U.S. PATENT DOCUMENTS

| | | | |
|---|---|---|---|
| 4,640,837 | 2/1987 | Coleman et al. | 426/94 |
| 4,735,812 | 4/1988 | Bryson et al. | 426/243 |
| 4,935,252 | 6/1990 | Huang et al. | 426/107 |
| 4,976,982 | 12/1990 | Gillmore et al. | 426/269 |
| 5,139,800 | 8/1992 | Anderson et al. | 426/243 |

*Primary Examiner*—Bruce A. Reynolds
*Assistant Examiner*—Tu Hoang
*Attorney, Agent, or Firm*—Charles E. Baxley

[57] ABSTRACT

A container for use in a microwave oven formed from a microwave transparent material and having coated on at least part of at least one inner surface thereof a browning agent for transfer of a brown coloration to a surface of a food item.

11 Claims, No Drawings

MICROWAVE CONTAINER

BACKGROUND OF THE INVENTION

The present invention relates to containers for use in cooking products in a microwave oven, and to a composite material for use in fabrication of such containers.

Microwave ovens are becoming a common feature in present day kitchens where their speed and convenience are greatly valued. Accordingly much attention is being paid in the food industry to increasing the types of products which may be cooked in such ovens. A persistent problem, however, has been inability of simple microwave ovens, without special features, to "brown" those products which undergo browning in a conventional oven. This problem arises from the fact that no radiant or convective heat transfer occurs in a simple microwave oven; in fact the food itself absorbs the radiation and heating takes place throughout the food article primarily due to microwave heating of water therein, although some heat transfer by conduction also may take place.

It has been suggested to include in packages for use in microwave ovens one or more metal inserts (susceptors) which absorb microwave radiation—the package material itself must of course be microwave transparent. While such inserts can brown certain areas of a food item, they can become too hot at edges and particularly at corners of packages and the food can become burnt. Various arrangements of the susceptors have been proposed to overcome this problem but these arrangements have proved suitable for certain applications only.

It also is possible to incorporate a browning agent on the surface of the food itself. Such browning agents are well known but have the disadvantage that they can only be used to coat solid food items. A semi-liquid cake batter, for instance, would tend to distribute the browning agent throughout the batter during mixing and the entire cake would be "browned". Such a product would not resemble a conventional oven browned food item and would be less acceptable to the customers.

DESCRIPTION OF RELATED ART

U.S. Pat. No. 4,735,812 suggests incorporation of a browning agent into a film for application to a food item, for example edible collagen film of a sausage casing.

SUMMARY OF THE INVENTION

We have now found that by an apparently simple expedient of coating the browning agent onto a suitable rigid microwave transparent material, for example food grade card, in contact with a surface of a food item, the latter can be acceptably browned on its contact surface only, when cooked in a microwave oven even where the food item is liquid or semi-liquid.

DESCRIPTION OF THE PREFERRED EMBODIMENTS

According to a first feature of the invention we provide a container for use in a microwave oven formed from a microwave transparent material and having coated on at least part of the inner surface thereof a browning agent for transfer of a brown coloration to the surface of a food item.

The coated material itself is a new development and one method of making the container according to the invention is to coat the browning agent onto the microwave transparent material and to fold or form same into an appropriate shape. A further aspect of the invention therefore provides a microwave transparent material having coated on one side thereof a browning agent for browning the surface of a food item.

The microwave transparent material may be any food grade plastic or cardboard material known for use in containers for microwave ovens; however cardboard is preferred, generally with a protective layer on at least the side which will come into contact with the food item. Such a layer may be for example, a polyester, polypropylene or nylon film.

The browning agent may be any commercially known coloring agent which produces a suitable brown color on food products particularly on heating, e.g. anatto or malt extract. The browning agent may be applied to the microwave transparent material in an aqueous binder, in a high melting-point fat or even, where its adhesion characteristics permit, without any binder. Malt extract is an example of this latter type of browning agent.

Suitable aqueous binders include gelatin, starch and starch derivatives such as Amylogum (an acetylated starch derivative supplied by Avebe, Rainham, Gillingham, Kent, England) and P-Kote (an acid thinned starch with maltodextrin supplied by National Starches, Trafford Park, Manchester, England). Gums such as gum arabic may also be used. Fat-based binders include, for example, palm kernel oil.

The browning agent and, where used, the binder should desirably be chemically stable once applied to the microwave transparent material and dried. A hygroscopic system would, of course, be largely unacceptable since it would have a short shelf life. It would similarly be undesirable for any slow chemical-deterioration to occur during storage, because the browning agent will ultimately be applied to a food item for human consumption. The browning agent coating thus should desirably be stable for 6–9 months, preferably 9–12 months or more, under normal storage conditions.

The browning agent/binder system also must be physically stable in that it does not flake or rub off from the interior of the container as this will give a patchy browning effect. A slightly uneven application of the browning agent to the container may in some cases be desired, however, in order to give a pleasing 'natural' appearance to the cooked food item.

The drying conditions to achieve this good physical stability are important and will depend on the browning agent and the binder used. Typically the browning agent will be applied suspended in a binder at a concentration of 0.1% to 2% by weight, preferably about 0.4%, to give an overall coating weight of 0.002 to 0.02 $g/cm^2$, preferably 0.01 to 0.02 $g/cm^2$. Drying will normally be for 6 to 10 minutes at 60° C.

It would also be possible to apply browning agents to the microwave transparent material using a non-aqueous solvent system, for example alcohol based solvents, followed by drying. Browning agents which could be applied in this way include malt extract and other colors.

Other additives which might be included in the coating include flavourings, such as sweeteners, where it is desired to flavour only the surface of the food item, and emulsifiers such as lecithin to facilitate dispersion in the aqueous medium used for application of the browning agent.

The end product for retail sale generally will consist of a container according to the invention, a food item such as a dry cake mix contained in a sachet, and a lid, perhaps contained in a packet or wrapper. The food item may be removed from its sachet; subjected to any necessary mixing or other treatment, usually to form a semi-liquid food mix; returned directly to the container; and finally placed in a microwave oven for cooking.

The invention is illustrated by the following example.

EXAMPLE

Coating compositions were prepared according to the following formulations:

150 ml water
20 g Amylogum
20 g sugar
0.2 g annatto
0.6 g caramel

Method—The water was heated to 80° C. The Amylogum and sugar were mixed, added to the water and mixed. Heating was stopped and the annatto and caramel were added and mixed. The compositions were coated onto a ready-folded container at a coating weight of 0.01–0.02 g/cm$^2$ (5 g of coating for a 15×19×2.5 cm tray) by brushing and dried at 60° C. for 8 minutes in a fan oven. The coated layers showed no deterioration over a period of 9 months when stored at 36° C. and 75% humidity and gave an acceptable brown surface appearance to a standard instant cake batter when this was placed in the container and cooked in a microwave oven for 7 minutes on high power.

We claim:

1. A container for use in a microwave oven, the container having at least one surface arranged to come into immediate contact with a food item therein, the container formed from a microwave transparent material and having coated on at least a part of said surface a browning agent for transfer of a brown coloration to a surface of the food item.

2. The container as claimed in claim 1, wherein the microwave transparent material is cardboard.

3. The container as claimed in claim 2, with the cardboard further comprising a protective layer selected from a group consisting of polyester, polypropylene and nylon on said surface.

4. The container as claimed in claim 2, wherein the browning agent is annatto.

5. The container as claimed in claim 2, wherein the browning agent is malt extract.

6. The container as claimed in claim 2, wherein the browning agent is applied in an aqueous binder.

7. The container as claimed in claim 2, wherein the browning agent is applied in a high melting-point fat.

8. The container as claimed in claim 2, wherein the browning agent has a weight of from 0.002 to 0.02 g/cm$^2$.

9. A package comprising in combination:

a food item, a container for use in a microwave oven, the container provided with a lid and having a surface arranged to come into immediate contact with the food item contained therein, the container formed from a microwave transparent material and having coated on at least part of said surface a browning agent for transfer of a brown coloration to a surface of the food item.

10. The package as claimed in claim 9 wherein the food item is a dry cake mix.

11. A method for microwave cooking of a semi-liquid cake mix comprising:

(a) placing the cake mix in a container formed from a microwave transparent material and having at least one surface coated thereon with a browning agent;

(b) subjecting the cake mix in said container to microwave radiation to cook the cake mix whereby the browning agent is transferred to a cake surface of the cake mix and imparts a brown coloration to the cake surface as the cake is cooked.

* * * * *